US010493653B2

(12) United States Patent
Herrmann et al.

(10) Patent No.: US 10,493,653 B2
(45) Date of Patent: Dec. 3, 2019

(54) METHOD FOR PRODUCING PANELS HAVING RECESSES

(71) Applicant: Fritz EGGER GmbH & Co. OG, St. Johann in Tirol (AT)

(72) Inventors: Eberhard Herrmann, Wismar (DE); Marco Drochner, Gallentin (DE)

(73) Assignee: Frtiz EGGER GmbH & Co. OG, St. Johann in Tirol (AT)

( * ) Notice: Subject to any disclaimer, the term of this patent is extended or adjusted under 35 U.S.C. 154(b) by 0 days.

(21) Appl. No.: 15/572,602

(22) PCT Filed: Apr. 28, 2016

(86) PCT No.: PCT/EP2016/059489
§ 371 (c)(1),
(2) Date: Nov. 8, 2017

(87) PCT Pub. No.: WO2016/180643
PCT Pub. Date: Nov. 17, 2016

(65) Prior Publication Data

US 2018/0133922 A1 May 17, 2018

(30) Foreign Application Priority Data

May 11, 2015 (DE) ..... 10 2015 005 864

(51) Int. Cl.
*B27M 3/04* (2006.01)
*E04F 15/02* (2006.01)
(Continued)

(52) U.S. Cl.
CPC ..... *B27M 3/04* (2013.01); *E04F 15/02033* (2013.01); *E04F 15/02038* (2013.01);
(Continued)

(58) Field of Classification Search
CPC ..... B27M 3/0093; B27M 3/04; B27M 3/06; B27M 1/00; B27M 1/08; B27M 1/003
(Continued)

(56) References Cited

U.S. PATENT DOCUMENTS 3,621,615 A * 11/1971 Ottinger ..... B24B 7/28
144/136.1
7,716,896 B2 * 5/2010 Pervan ..... B44C 3/12
52/578
(Continued)

FOREIGN PATENT DOCUMENTS

DE 19963203 A1 9/2001
DE 10019054 C1 12/2001
(Continued)

*Primary Examiner* — Matthew Katcoff
(74) *Attorney, Agent, or Firm* — The Webb Law Firm

(57) ABSTRACT

A method for producing panels having an upper usable surface and locking profiles for mechanical locking of similar panels to one another, wherein recesses are provided on at least two edge regions lying opposite one another, and the recesses of two similar panels locked to one another form a mutual joint can include dividing a half-form, which includes a plurality of panel blanks with at least two grooves forming the recesses into multiple half-form parts. The type/position of at least one identification mark of the half-form parts can be detected. The half-form parts and a processing tool can be aligned to one another according to the detected type/position of the identification mark. A locking profile can be machined from the half-form parts by the processing device on at least one side of the half form parts.

18 Claims, 5 Drawing Sheets

(51) Int. Cl.
*E04F 15/10* (2006.01)
*E04F 15/04* (2006.01)

(52) U.S. Cl.
CPC ..... *E04F 15/045* (2013.01); *E04F 15/102* (2013.01); *E04F 2201/0153* (2013.01)

(58) Field of Classification Search
USPC ..... 144/371
See application file for complete search history.

(56) References Cited

U.S. PATENT DOCUMENTS

| | | | | |
|---|---|---|---|---|
| 8,161,701 | B2 * | 4/2012 | Cappelle | B27B 5/06 52/390 |
| 2001/0047702 | A1 | 12/2001 | Tychsen | |
| 2006/0179773 | A1 | 8/2006 | Pervan | |
| 2007/0079925 | A1 | 4/2007 | Hansson et al. | |
| 2007/0209736 | A1 | 9/2007 | Deringor et al. | |
| 2008/0099105 | A1 * | 5/2008 | Kelly | B27M 1/08 144/371 |
| 2009/0049792 | A1 | 2/2009 | Cappelle et al. | |
| 2012/0156432 | A1 | 6/2012 | Gerbl | |

FOREIGN PATENT DOCUMENTS

| | | | |
|---|---|---|---|
| DE | 112004002175 | T5 | 10/2006 |
| DE | 102009060103 | A1 | 6/2011 |
| DE | 102010019567 | A1 | 11/2011 |
| DE | 102011081075 | A1 | 2/2013 |
| EP | 2108492 | A1 | 10/2009 |
| WO | 9961212 | A1 | 12/1999 |

* cited by examiner

METHOD FOR PRODUCING PANELS HAVING RECESSES

CROSS-REFERENCE TO RELATED APPLICATIONS

This application is the United States national phase of International Application No. PCT/EP2016/059489 filed Apr. 28, 2016, and claims priority to German Patent Application No. 102015005864.9 filed May 11, 2015, the disclosures of which are hereby incorporated in their entirety by reference.

BACKGROUND OF THE INVENTION

The invention relates to a method for producing panels, in particular flooring panels, comprising an upper usable surface and locking profiles for mechanical locking of similar panels to one another, wherein recesses are provided on at least two edge regions of the usable surface lying opposite one another and wherein the recesses of two similar panels locked to one another form a mutual join. The invention further relates to a half-form for producing panels, in particular flooring panels, in particular according to the stated method, with at least two grooves running substantially parallel and separated from one another by at least one web. The invention also relates to a pressing tool for pressing a carrier plate with at least one wear layer, in particular for producing a half-form of the stated type, wherein the pressing tool comprises at least two raised rib structures running substantially parallel to one another for imprinting at least two substantially parallel grooves in a half-form.

Flooring panels or panels put to other uses are typically provided with decoration. This makes the panels attractive and allows them to be used for various purposes. Here it has been increasingly sought to improve the visual and haptic impression of the panels. The decoration of, by way of example, flooring panels is often inspired by the appearance of, by way of example, solid wood, tiles or stones, so that in the laid state of the flooring panels the impression of a wooden floor, tiled floor, stone floor or similar is created. In order to imitate the original as closely as possible, the usable surface of the panels can, by way of example, be intentionally provided with recesses or elevations, so that surface textures are obtained which correspond to those of wood, tiles, stones and similar. An example of this is what are known as wood pores, which can be imitated by selective recesses in the usable surface of the panels.

Here, the usable surface is considered to be the surface of the panels, which contributes to forming the upper surface of the layer formed by a plurality of panels joined together. The usable surface typically has four edges, beyond which optionally locking profiles of the panels can extend further outwards which serve only to join the panels and not to form the upper surface of a layer made up of panels. Here, the locking profiles are preferably configured so that they allow a mechanical, in particular positive-fit, locking of the panels against one another. Here the locking expediently works both in a direction parallel to the panel plane and vertically to the corresponding side edge, and vertically to the panel plane.

It is often desirable to imitate a join between panels joined together, as happens with wall, ceiling or floor coverings of wooden floorboards, stones or tiles. This is achieved by the edge regions of the useful surfaces of the panels being chamfered or rounded. When similar panels are in the joined state, the recesses form a mutual join, which by way of example can have a V-shaped cross-section, for instance in order to imitate the joins between floorboards. By adjusting the cross-section of the joins formed by two adjacent panels or the form of the recesses in the edge regions of the useful surfaces other coverings can also be imitated.

The production of panels having such recesses is very complicated, however, or results in a large proportion of defective panels. Typically, to begin with half-forms in the form of sheets are produced, which may have a multi-layered structure. Here, this multi-layer structure can already correspond to that of the panels to be produced. The half-forms usually have a carrier plate in a wooden material, for instance a fibreboard, on which an upper decorative wear layer and a lower backing layer are arranged. Optionally, impact sound insulation can also be added as a finish below. The wear layer and the backing layer have in particular at least a paper impregnated with resin, for instance melamine resin. Further such layers can be provided. In addition, particles to increase the wear resistance can also be used by way of example. In addition, the wear layer and the backing layer are typically pressed with the carrier plate. The wear layer and the backing layer can, however, also be formed by the application of at least one varnish layer in each case. In this case, the decoration of the wear layer is preferably printed onto the half-form.

Here, in the side of the half-form forming the usable surface, grooves, in particular with chamfered or rounded usable surfaces can be pressed, which at least partially form the recesses in the edge regions of the useful surfaces of the subsequent panels. From the half-form, in a downstream processing step, panel blanks are then cut out along the grooves, wherein the groove is partly removed. At the latest at the time of the machining of the locking profiles the groove has been removed to such an extent that on the finished panel only the recesses in the edge regions of the useful surfaces remain.

Both when separating the half-form into half-form parts, in particular panel blanks, and when machining the locking profiles, inaccuracies may arise. Thus, sometimes more and sometimes less of the groove pressed into the half-form is removed, for which reason the recesses in the edge regions of the usable surface may differ from panel to panel. This can, by way of example, result in the joins not being straight or being of different widths between the panels joined together. If the recesses of panels joined together do not meet each other in the panel joining area, moisture may penetrate the carrier plate in the vicinity of the mismatch, in particular if the carrier plate is made from a wooden material. In order to prevent these disadvantages, more technical equipment has to be used and the speed of production considerably reduced in order to be able to increase the production accuracy. The production is then associated with significantly higher costs, however.

SUMMARY OF THE INVENTION

The object of the present invention is therefore to design and further develop the method mentioned and described above in such a way that the panels with recesses provided in edge regions of the usable surface can be simply, quickly, economically and accurately produced.

This object is solved according to the disclosed subject matter by a method for producing panels, in particular flooring panels, comprising an upper usable surface and locking profiles for mechanical locking of similar panels to one another, wherein recesses are provided on at least two edge regions of the usable surface recesses lying opposite to one another and wherein the recesses of two similar panels locked to one another form a mutual join, in which a half-form which comprises a plurality of panel blanks with at least two grooves forming the recesses, is divided in particular substantially parallel to the at least two grooves, into multiple half-form parts, in particular multiple panel blanks, in which the type and/or position of at least one identification mark of the half-form parts, in particular the panel blanks, is detected, in which the half-form parts, in particular the panel blanks, and at least one processing tool of a processing device are aligned to one another according to the detected type and/or position of the at least one identification mark and in which a locking profile is machined from the half-form parts, in particular the panel blanks, by the processing device on at least one side of the half-form parts, in particular the panel blanks, preferably on two opposite sides.

The method therefore makes use of a half-form, comprising a plurality of panel blanks, from which through further processing the panels are then produced. From the half-form, through suitable cutting at least multiple half-form parts are obtained. It is particularly preferred, however, to divide the half-form in such a way that a plurality of panel blanks is directly obtained. Otherwise, the half-form parts then still have to be divided into individual panel blanks or panels.

The half-forms have at least two grooves, which are in particular aligned substantially parallel to one another. Here, each of the grooves comprises at least one groove edge, forming at least partially the recess in the edge region of the usable surface of the panels. A recess in the edge region is preferably understood here to be a region of the usable surface, which is set back in relation to the region delimiting it from the centre of the panel and/or in relation to the majority of the usable surface and/or in relation to the average arrangement of the usable surface in the direction of the carrier plate or in the direction of the rear of the carrier plate.

The half-forms can also be produced according to the method in preceding work steps, if desired. Along the grooves, the half-form is separated into at least half-form parts, wherein the half-form parts or the panel blanks obtained in this way have identification marks or identification mark symbols. The identification mark symbols or identification marks preferably already existed on the half-form. Identical identification marks or identification mark symbols do not also have to be present on the half-form parts or panel blanks, however. Rather, the identification mark symbols of the half-form can be partially removed or destroyed when cutting the half-form into half-form parts or panel blanks. Only in the latter case must a distinction be made between identification mark symbols and identification marks, wherein the designation identification mark designates at least one part of an identification mark symbol. Otherwise, identification mark and identification mark symbol can also be understood to be synonymous.

The at least one identification mark can be detected by suitable devices, and in relation to its type and/or position. Here, the type and/or position of the identification marks can vary depending on how accurately the half-form parts and/or the panel blanks have been created from the half-form. Therefore, only low accuracy is necessary here or slight deviations are not damaging. The deviations are subsequently detected, and by suitable alignment of the half-form parts, in particular the panel blanks, in relation to at least one processing tool of a processing device. This alignment is performed as a function of which type and/or position of the at least one identification mark associated with the corresponding half-form part, in particular the panel blank identification mark, was detected first.

The nature of the identification mark can, by way of example, depend on how the half-form part or panel blank has been cut from the half-form, in particular sawn out. In this method step optionally an identification mark symbol can be processed or changed so that the remaining identification mark shows how exactly the half-form part or the panel blank was cut from the half-form in relation to the at least one groove. Information can also be inferred, however, on the amount and direction of deviation from the optimum cutting of the half-form part or panel blank from the half-form. If, by way of example, when cutting the half-form, the identification mark symbol is sawn through, other identification marks will be obtained in the process, depending on the point at which the identification mark symbol has been sawn through.

An identification mark can also be provided, however, which is not altered when cutting out half-form parts or panel blanks. Then there is no difference between identification mark and identification mark symbol. However, in this case as well, the position in relation to, for instance, an edge of the half-form part or panel blank or another reference point can also depend on the accuracy during separation of the half-form.

Here, the identification mark can be arranged in the usable surface of the subsequent panel, for instance in the decoration, but also alongside this. The latter is preferable, because the detection of the identification mark is not then impaired by the decoration and because the identification mark or the identification mark symbol is not removed during the processing of the half-form part or panel blank following detection. The detected deviation can be compensated for in a subsequent operation, by aligning the half-form part or the panel blank to at least one processing tool of a processing device.

Here, the processing tool can optionally simply serve to correct a previous inaccuracy in the processing of the half-form parts or panel blanks. For economy of processing tools, however, it is particularly preferable if the at least one processing tool at the same time performs a processing of the half-form parts or the panel blanks that was necessary in any case. This is a case, in particular, of the at least partial machining of a locking profile of the corresponding panel. This then takes place, however, optionally after processing with the at least one processing tool collectively in the associated processing device.

Through the alignment of the half-form parts or panel blanks in relation to the at least one processing tool and/or through the alignment of the at least one processing tool in relation to the half-form parts or panel blanks, in each case based on the respective position and/or type of identification mark associated with the half-form part or panel blank the machining takes place of the locking profiles at the right position in relation to the panel to be produced in each case, even if the previous cutting of the half-form was not precise. For the corresponding alignment preferably a device is used which can be adjusted quickly enough to allow production of panels and high speed.

To be able to produce the locking profiles with the desired high accuracy, these are preferably machined on opposing side edges preferably simultaneously. Thus, optionally, a single alignment of the half-form parts or the panel blanks in relation to the at least one processing tool of the processing device is necessary to provide locking profiles with high accuracy in relation to the recesses on two opposing sides. Optionally, however, during the further processing of each individual edge a separate detection of the at least one identification mark and/or a separate alignment of the half-form part or panel blank in relation to the at least one processing tool of a processing device can take place.

Moreover, both the longitudinal edges and transversal edges or both the long edges and the short edges can be produced with high accuracy. It makes sense here to process all surrounding edges of the panel blanks in the corresponding way. In any case, though, multiple edges can be produced in the abovementioned way with the abovementioned accuracy. This benefits the aesthetics and accuracy of the overall covering produced from the panels.

In a first preferred configuration of the method it can therefore be provided that, after the machining of a locking profile on at least one side of the half-form parts, in particular the panel blanks, the type and/or the position of at least one identification mark of the half-form parts, in particular the panel blanks, is detected. Here it is a case of repeating the step of detecting the at least one identification mark, in particular however at least one other identification mark, to be able to guarantee high accuracy also during the further processing. In each case, according to the detected type and/or position of the at least one identification mark, the half-form parts, in particular the panel blanks, and at least one processing tool of a processing device are then aligned with one another. Here also, the same at least one processing tool of the same processing device can be involved. Preferably, however, at least one other processing tool of another processing device is involved, in order to speed up panel production. The processing device then machines on at least one side of the half-form parts, in particular the panel blanks not yet provided with a locking profile, preferably on two opposing sides not yet provided with a locking profile, a locking profile from the half-form parts, in particular the panel blanks.

In a particularly simple and at the same time particularly effective case, at least one first identification mark regarding the type and/or the position is detected, then a corresponding alignment of the half-form parts or panel blanks is performed and from two of the four side edges of the panel blanks locking profiles are machined. Then a further detection of at least one second identification mark regarding its type and/or position, a further corresponding alignment and then a machining of the locking profiles from the other two opposite side edges, on which no locking profiles are yet provided, takes place.

In order to be able to produce both longitudinal edges and transversal edges or also edges perpendicular to one another, which may have the same length, with recesses in the edge regions of the useful surfaces the panels, it is particularly expedient, to use a half-form with in each case at least two perpendicular grooves, preferably a row of grooves running either perpendicularly or parallel to one another or to initially produce such a half-form. Here at least one side of the grooves forms at least one part of a recess in the edge region of the usable surface of a panel. Then, by way of example, the panel blanks or panel recesses can be configured on the longitudinal sides and on the transversal sides.

In order that the panels can be provided with surrounding recesses, it is appropriate if on four surrounding edge regions of the panel blanks of a half-form in each case at least one groove forming a recess is provided. In this way, in particular, on four surrounding edge regions of the usable surface of the panels recesses can be provided. Both allow the formation of a visually attractive covering, that can be very similar to a particular original. Similarly, from four surrounding edges of the panel blanks locking profiles can be machined. Then the similar panels of a covering can be locked on all four sides with further panels thereby forming a permanently stable covering.

It is also conceivable that just the longitudinal sides of the panels are provided with recesses in the corresponding edge regions. If the half-form parts or panel blanks are cut slightly diagonally from the half-form, it may be expedient to feed these slightly rotated about an axis vertical to the half-form parts or panel blanks or with a somewhat different transport device to the further processing device. Diagonal half-form parts or panel blanks can be easily detected, if along the longitudinal sides of the half-form parts or panel blanks at least two identification marks or identification mark symbols are provided. These are also particularly expediently provided in the vicinity of the opposite ends of the longitudinal sides of the half-form parts or panel blanks. Then an obliqueness can be detected more easily than if the identification marks or identification mark symbols were provided in the vicinity of the centre.

In order to allow a reliable and accurate detection of the at least one identification mark of the half-form parts, in particular the panel blanks, according to its type and/or position in an economical manner, the at least one identification mark can be detected by an optical sensor, in particular a camera. Alternatively, or additionally, the desired alignment of the half-form parts, in particular the panel blanks, in relation to the at least one processing tool of a processing device can be detected and controlled by an evaluation and control unit. This ensures that inaccuracies present from the processing of the half-form parts or the panel blanks can be compensated for in relation to the subsequent recesses. In particular, the recesses are produced particularly in relation to the panels. Here, the control is based in particular on the type and/or the position of the at least one identification mark of the half-form parts, in particular the panel blanks, which has been ascertained in advance. The type and/or the position of the at least one identification mark thus determines the subsequent compensation of any inaccuracies.

Particularly simple, reliable and accurate alignment of the half-form parts, in particular the panel blanks, in relation to the at least one processing tool of a processing device, is possible by adjusting an adjustable stop for the half-form parts, in particular the panel blanks. The half-form parts, in particular the panel blanks, are aligned with the stop and thus brought into contact with this at a defined position in relation to the at least one processing tool. In this way, during the processing of the half-form part, in particular the panel blank, with the at least one processing tool compensation of inaccuracies present is achieved, by the stop being adjusted to compensate for these inaccuracies. Optionally, the stop is adjustable linearly and perpendicularly to the transport device of the half-form parts or panel blanks. Alternatively, or additionally, however, the inclination of the stop to the transport device can be varied. Here the transport device can be understood as the transport device without inclination of the stop, since a slight inclination of the stop can have an effect on the transport device of the half-form parts or panel blanks at least along the stop. A linear adjustment of the stop can compensate for a constant offset during the previous processing, while the adjustment of the inclination can ensure that the recess is always configured parallel to the associated panel edge.

Alternatively, or additionally, the alignment of the half-form parts, in particular the panel blanks, in relation to the at least one processing tool of a processing device can also take place by adjusting the at least one processing tool. Here the adjustment is then preferably performed in relation to an in particular fixed, stop for the half-form parts, in particular for panel blanks, in order to have a reference for the adjustment of the at least one processing tool of a processing device. So, the half-form part or the panel blank can be aligned in relation to at least one processing tool or the at least one processing tool in relation to the half-form part or the panel blank. The two could also be combined, though this would require more complicated control and equipment engineering.

Interconnected panels are particularly aesthetic if the at least one recess is configured in the edge region of the usable surface as a chamfer and/or rounding. Then, by way of example, the look and feel of floorboards can be recreated. Alternatively, or additionally, the at least one recess can be provided so that two similar panels locked to one another form a mutual V-shaped, U-shaped or right-angled join. In this way, the join can be easily adapted to the covering to be imitated. Basically, however, recesses can be provided with any form.

With the half-form, at least two grooves separated by at least one web can be provided. This requires less pressing forces than when pressing a wider groove. Furthermore, in the regions that have not been deepened a greater contact pressure can be achieved. In this way, the usable surface or wear layer can by way of example achieve a higher gloss level. When the half-form parts or panel blanks are separated from one another the web can also be partially removed. The remainder of the web is then removed during further processing of the half-form parts or the panel blanks. Thus, it does not matter if a web is provided between the grooves on the half-form.

In this connection, it is particularly preferred, if on the at least one web at least one identification mark symbol is provided. The identification mark or the identification mark symbol can then be provided separately from the subsequently visible usable surface of the panel, which is not impaired by the identification mark or the identification mark symbol. Furthermore, this allows the identification mark to be easily and accurately detected. Here the identification mark symbol can optionally be partially removed when the half-form is divided into half-form parts, in particular panel blanks.

The remaining part of the identification mark symbol then forms the identification mark to be subsequently detected. By way of example, depending on where the identification mark is cut through, different points of the identification mark symbol remain at different points in relation to the cut edge.

The detectability of the at least one identification mark can be improved if the identification mark and/or the identification mark symbol involves at least one diamond symbol, in particular at least one double diamond symbol, and/or at least one textured identification mark symbol. Diamond symbols or parts of these can be detected very accurately and reliably. In addition, parts of the diamond symbol remaining if, for example when the half-form parts or panel blanks are separated, a part of the diamond symbol is removed, can also be very easily detected with regard to their position and/or type. Alternatively, or additionally, a texturing of the identification mark symbol or the identification mark improves its detection, wherein the identification mark symbol or the identification mark can be configured to at least to some extent be raised or lowered in relation to the adjacent regions. The textured identification mark symbol or the textured identification mark do not therefore have a smooth configuration.

In order to easily and efficiently make the at least one identification mark and/or at least one identification mark symbol in each case at least partially in the half-form, this can take place during the pressing of a carrier plate of the half-form with a wear layer and/or during the imprinting of the at least two grooves in the half-form. It is particularly preferred, however, if these are performed together in a single combined pressing step. Then, on the one hand, at least a part of the at least one identification mark and/or at least a part of the at least one identification mark symbol and, on the other, the at least two grooves can be imprinted in the half-form during the pressing of a carrier plate with at least one wear layer. This is simple, accurate and economical.

If for panel blanks the surrounding side edges are processed with the compensation of possible inaccuracies, on the half-form along the longitudinal sides of the half-form parts, in particular panel blanks, at least two identification mark symbols and/or along the transversal sides of the half-form parts, in particular the panel blanks, at least one identification mark symbol is/are provided. On the optionally shorter transversal sides, one identification mark symbol or an identification mark may suffice, whereas on the optionally longer longitudinal sides two identification mark symbols or identification marks for the alignment of the panel blanks or the half-form parts may be expedient, for instance in order to be able to ensure straight running recesses.

It is particularly simple and economical if the half-form parts, in particular panel blanks, are sawn from the half-form. Additionally, or alternatively, the production costs can be reduced if the locking profiles of the half-form parts, in particular the panel blanks, are milled out.

Laminates of a suitable kind are, by way of example, obtained, if the half-form, has a surface layer forming an in particular decorative, usable surface. Here, the surface layer preferably has a multi-layer structure. In this case the surface layer can comprise at least one resin-soaked Kraft paper. The resin is also preferably melamine resin, which is highly resistant. Moreover, further elements or sublayers can be provided, offering decoration and/or improving the wear resistance. The surface layer is expediently provided on a carrier plate, preferably made of a wood material, in particular a medium density fibreboard (MDF) or high density fibreboard (HDF). Here, the surface layer can be pressed with the carrier plate, wherein the grooves are simultaneously created in the half-form. A further underside layer can be provided, referred to as a backing layer and leading to stress relief in the panel. The pressing of the surface layer with the carrier plate takes place in particular at high temperature with a press working continuously or in cycles, that can comprise a pressing belt or a pressing plate.

The abovementioned object is also solved by a half-form according to the disclosed subject matter in that the at least one web is provided with at least one identification mark and/or at least one identification mark symbol. This allows the simple detection of the at least one identification mark and/or the at least one identification mark symbol and an alignment of the half-form parts or panel parts or panel blanks dependent on the detected type and/or position of the at least one identification mark and/or the at least one identification mark symbol for at least one further processing step. It is a case here in particular of the machining of locking profiles.

Here, the at least one identification mark and/or the at least one identification mark symbol can at least partially be impressed in the at least one web. This allows a simple application of the identification mark and/or the identification mark symbol. Alternatively, or additionally, however, a good detectability and/or perceptibility of the identification mark and/or of the identification mark symbol can optionally also be achieved.

The abovementioned object is also solved by a pressing tool according to the disclosed subject matter, in that the pressing tool between the at least two rib structures running substantially parallel to one another, has at least one raised structure for at least partially impressing at least one identification mark and/or at least one identification mark symbol in the half-form between the at least two grooves, in particular in a web of the half-form provided between the at least two grooves.

With a corresponding pressing tool, for instance in the form of a pressing plate or a pressing belt, the half-form can be quickly and economically produced for the method described. The at least partial impressing of at least one identification mark or at least one identification mark symbol can then take place in a single work step with the impressing of the grooves in the half-form or in a half-form blank or the carrier plate.

BRIEF DESCRIPTION OF THE DRAWINGS

The invention is explained in more detail below using a drawing showing just one exemplary embodiment. The drawing shows as follows.

DETAILED DESCRIPTION

Figure 1:
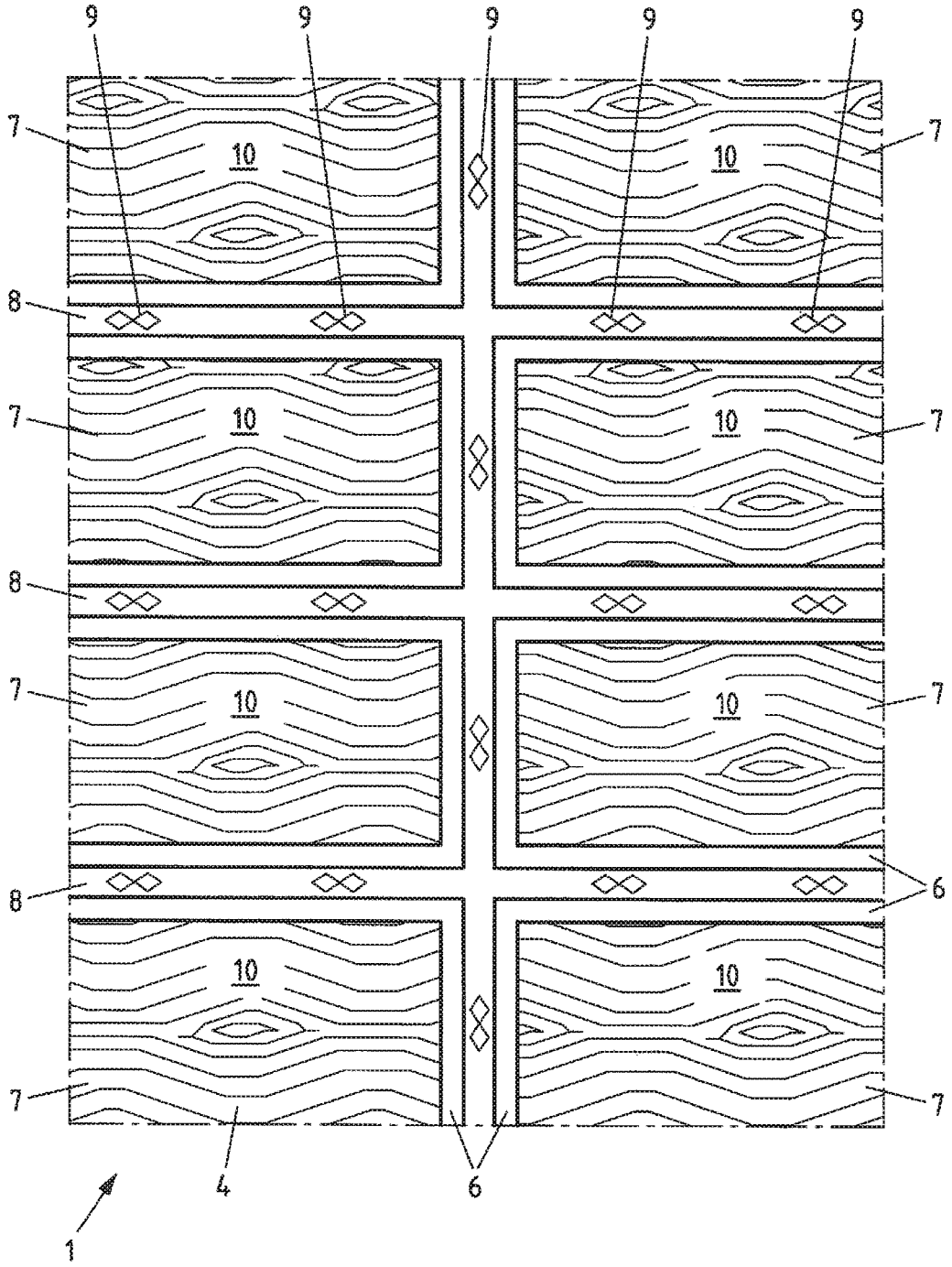
FIG. 1 a detailed top view of a half-form for use in a method according to the invention.
Figure 2:
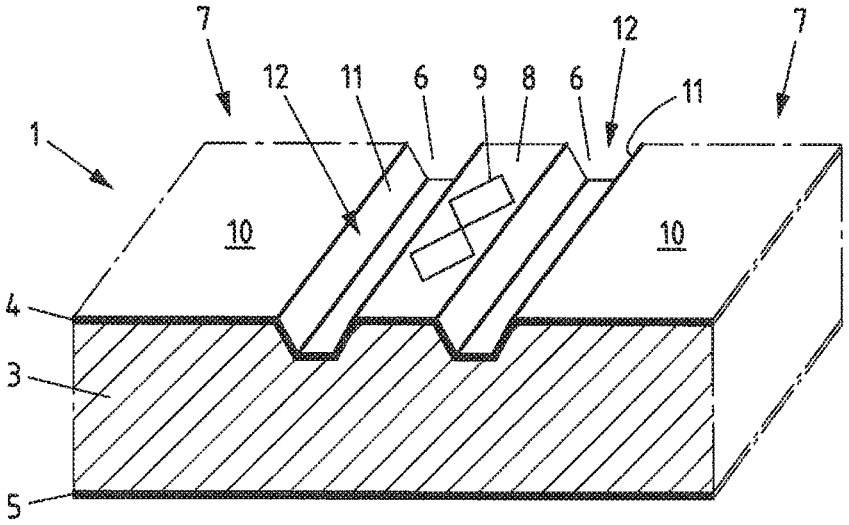
FIG. 2 a detailed perspective sectional view of a half-form for use in a method according to the invention.
Figure 5:
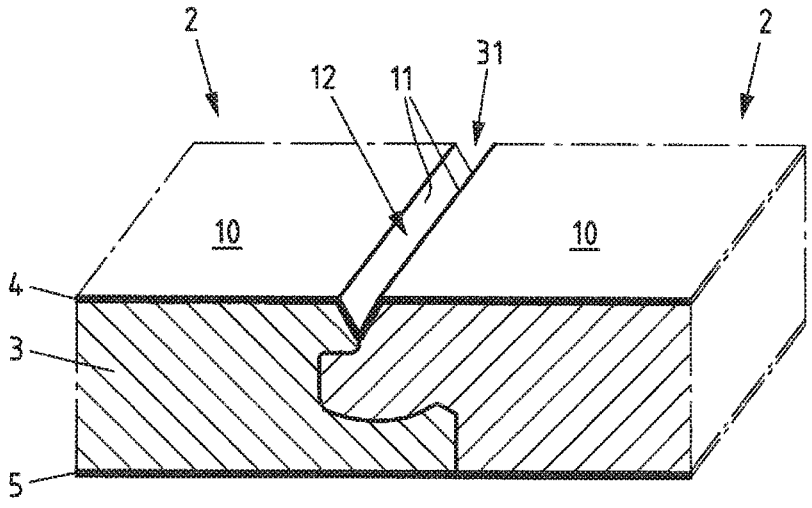

FIGS. 1 and 2 present in detail a half-form 1 that can be used for producing panels 2 according to FIG. 5. The half-form 1 presented and to that extent preferred comprises a carrier plate 3 in a wooden material in the form of a fibreboard, in particular high density fibreboard (HDF), pressed with a decorative wear layer 4 and opposite this with a backing layer 5. The wear layer 4 and the backing layer 5 each comprise at least one paper impregnated with resin, in particular melamine resin, onto which in the case of the wear layer 4 by way of example a wooden decoration is printed. During pressing of the carrier plate 3 with the wear layer 4 and the backing layer 5 grooves 6 are imprinted into the half-form 1. The wear layer 4 and/or the backing layer 5 can optionally, however, also be formed without paper by a varnish layer. In the case of the wear layer 4 a decoration is preferably provided, which can be applied by direct printing.

The half-form 1 presented and to that extent preferred comprises ten rows one after the other, each with two panel blanks 7. The half-form 1 presented and to that extent preferred thus allows a total of 20 panels to be produced. Around the individual panel blanks 7 the impressed grooves 6 are provided, running either parallel or perpendicularly to one another. In the threshold between two respective panel blanks 7 two grooves 6 are always provided, separated from one another by a web 8. On the webs 8, at regular intervals, identification mark symbols 9 in the form of double diamond symbols are provided.

The upper sides of the webs 8 are preferably arranged at the same height as the useful surfaces 10 of the panel blanks, as shown by way of example in the sectional view of the half-form 1 according to FIG. 2. When interconnected, the useful surfaces 10 of the panels 2 form the mutual upper side of the corresponding layer of panels 2. FIG. 2 also shows how the edges 11 of the grooves 6 imprinted into the half-form 1 run diagonally. The edges 11 of the groves turned towards the panel blanks 7 form recesses 12 in the edge regions of the useful surfaces 10 of the panels.

Figure 3A:
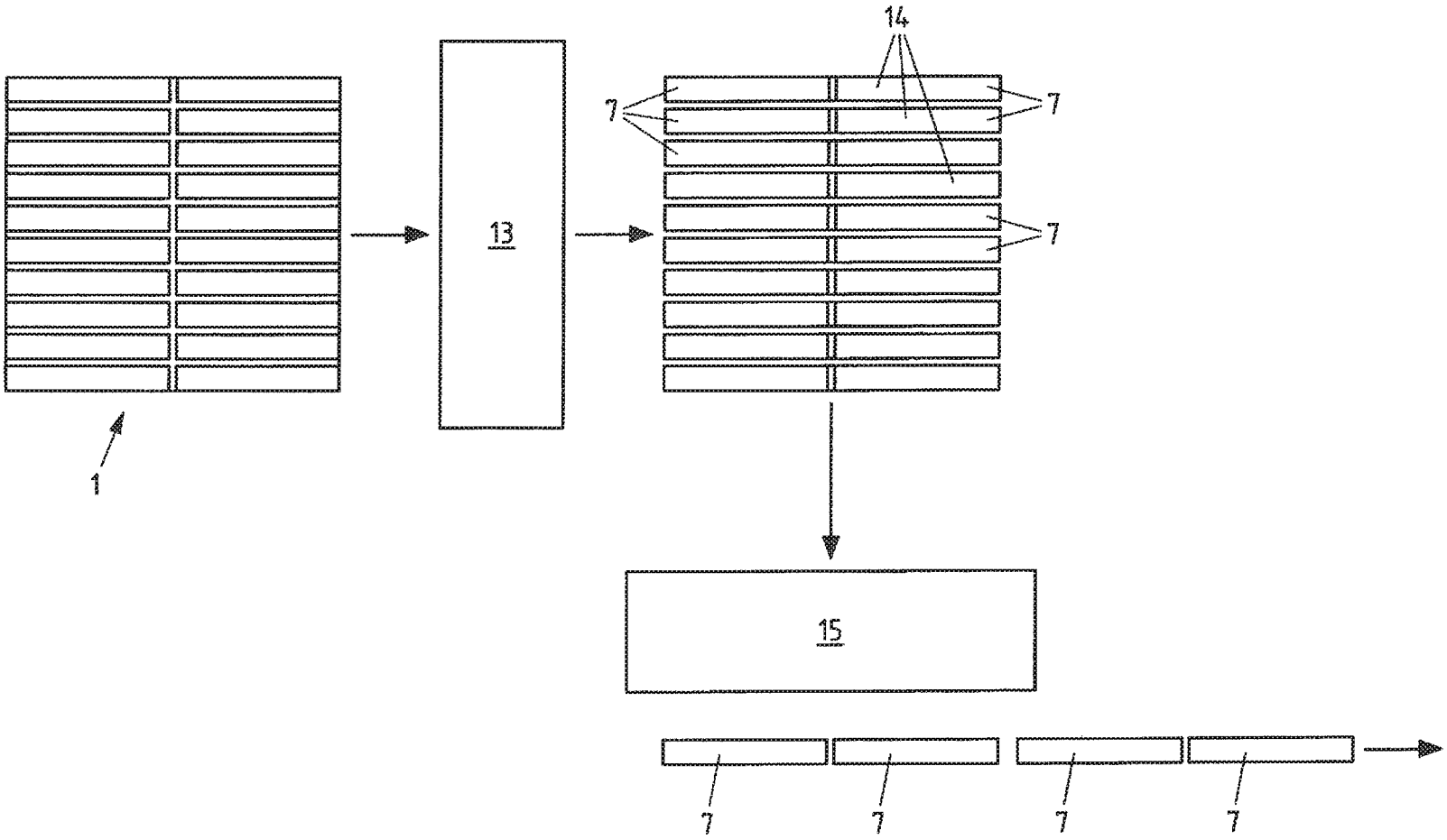
FIG. 3A-B a schematic representation of a method according to the invention.
Figure 3B:
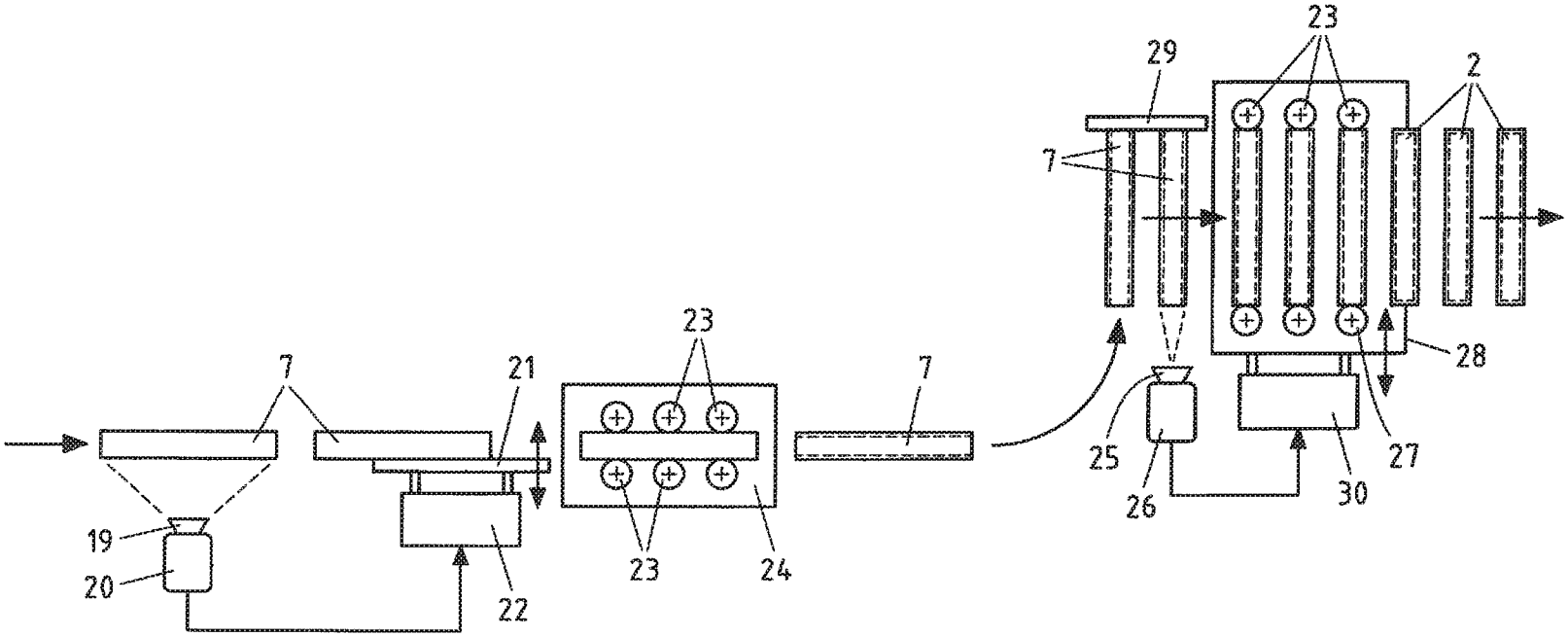

The production of the panels 2 is represented schematically in FIG. 3A-B. Initially a half-form 1 is used, as by way of example described in FIGS. 1 and 2. The half-form is fed to a first sawing device 13, in which the half-form 1 is sawn along the web 8 delimited by groves 6 in the transport direction of the half-form 1 into half-form parts 14, which in each case comprise two panel blanks 7. The half-form parts 14 produced in this way are then fed perpendicularly to the longitudinal sides to a second sawing device 15, in which the half-form parts 14 are sawn into individual panel blanks 7, along the web now bordered in the transport direction by grooves 6.

Figure 4:
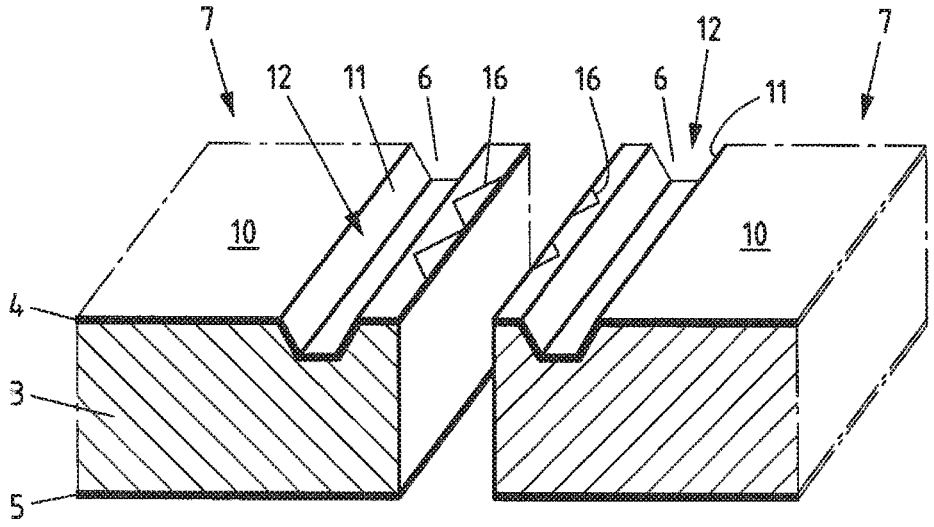
FIG. 4 a detailed perspective sectional view of the two half-form parts formed from the half-form according to FIG. 1 and FIG. 2, and FIG. 5 two panels joined to one another produced according to the method according to the invention of FIG. 3A-B.

During the sawing out of the panel blanks 7, the identification mark symbols 9 in the form of double diamond symbols provided on the webs 8 are sawn through. After the sawing, however, a residue of the identification mark symbols 9 as identification marks 16, as represented in FIG. 4 remains. If the separation of the half-form 1 does not take place centrally through the respective web 8, then either side of the cut edge there remain different sized proportions of the identification mark symbols 9 as identification marks 16. Where optimum sawing along the web 8 takes place also depends on the dimensions of the locking profiles 17, 18 still to be machined. Central separation of the webs 8 is therefore not always desirable if the interacting locking profiles 17, 18 protrude with different widths.

When the panel blanks 7 pass a sensor device 19 in the form of a camera the identification marks 16 remaining on a longitudinal side of the panel blanks 7 are detected. The parts of the identification mark symbol 9 that remain, or at what distance from the edge certain parts, in particular corners, of the identification mark symbols 9 are arranged, indicate with what offset in which direction and how parallel to the grooves 6 the panel blanks 7 have been sawn from the half-form 1. This is determined by an evaluation and control unit 20 linked to the camera, which controls a stop 21 in a corresponding manner. The stop can be adjusted by means of a drive 22, in particular a servo drive, and can be set for each panel blank 7 using the detection of the identification marks 16 such that the panel 2 is produced parallel to the grooves 6 and on both opposite edge regions same-width recesses 12 in the usable surface 10 are provided. To this end, the stop 21 presented and to that extent preferred can be adjusted both linearly in a direction perpendicular to the transport direction and optionally also slightly diagonally to the transport direction, in order to influence the transport direction. The latter is not absolutely necessary, however, for instance if it can be ensured that the separation of the half-form 1 always takes place sufficiently in parallel to the panel blanks 7. By adjusting the stop 21 each panel blank 7 is aligned in a suitable manner to the processing tools 23 of the subsequent processing device 24. The processing tools 23 mill locking profiles 17, 18 from the opposing longitudinal edges, by which similar panels 2 can be joined and locked to one another. Here the wear layer 4 of the panel blanks 7 is also shortened, so that only at least a part of an edge 11 of the groove 6 remains as a recess 12 in the edge region of the usable surface 10 of the panel 2.

The panel blanks 7 are then rotated and fed to a further sensor device 25 with a camera, which detects the identification marks 16 on the transversal sides of the panel blanks 7, in relation to their position and/or type. A connected evaluation and control unit 26 ascertains how the individual panel blanks 7 must be aligned to the processing tools 27 of the subsequent processing device 28, so that the same-width recesses 12 are obtained on both transversal sides of the panels 2 in the edge regions of the useful surfaces 10, aligned parallel to the transversal edges. To achieve this alignment between the panel blanks 7 and the processing tools 27 in the method presented and to that extent preferred, the processing tools 27 of the processing device 28 are aligned in relation to a stop 29 for the panel blanks 7. This takes place by means of a drive 30 connected with the processing device 28, in particular a servo drive. It would also be conceivable, however, instead of having the stop 29, to fix the panels without any particular alignment and to align processing devices either side by means of a drive 30 on the basis of the identification marks. By means of the corresponding processing tools 27 locking profiles 17, 18 are milled from the transversal edges, which serve to join and lock the panels 2. In doing so, here the wear layer 4 of the panel blanks 7 is also removed to the extent that only at least a part of an edge 11 of the groove 6 remains as a recess 12 in the edge region of the usable surface 10 of the panel 2.

FIG. 5 presents two similar panels 2 produced in the manner described above. The panels 2 are locked together on two side edges via their locking profiles 17, 18 in a direction perpendicular to the panel planes and also in a direction parallel to the panel planes and perpendicular to the joining edge. In the edge regions of the useful surfaces 10 of the panels adjacent to one another in the locked state recesses 12 are provided, in which the usable surface 10 and in particular also the wear layer 4 are lower than the majority of the remaining usable surface 10, thus set back in the direction of the underside of the panels 2 or into the carrier plate 3 thereof. Due to the production process described, the two recesses 12 are of the same width and aligned parallel to one another. In addition, in the panels 2 represented and to that extent preferred, the recesses 12 form a mutual join 31 with a for instance V-shaped cross section. Furthermore, the outer margins or edges of the useful surfaces 10 of the panels 2 joined together have the same height. Optionally, these margins or edges also meet so that the entry of moisture into the carrier plate 3 via the mutual join 31 is substantially prevented.

By means of the method described or a modified method, optionally panels of different lengths can be produced. It is preferred, however, if the panels are produced with identical widths. When the panels are laid in rows, it does not present a problem if the length of the panels to be joined varies. The widths of the panels must then always be the same, however, since this is not evened out when laying the panels in rows. Panels with the same width ensure that the panels can be assembled into a common covering, in particular floor covering.

The invention claimed is:

1. A method for producing panels having an upper usable surface and locking profiles for mechanical locking of corresponding panels to one another, the method comprising:

providing a carrier plate that forms a plurality of panel blanks connected to one another via a plurality of webs, wherein the webs that divide the panel blanks comprise at least one identification mark symbol and wherein each panel blank comprises at least two grooves with one groove corresponding to one side of each panel blank dividing the plurality of panel blanks along the webs such that the plurality of panel blanks on the carrier plate are separated from one another thereby dividing the identification mark symbols into separate identification marks detecting at least a type or position of the identification marks provided on each panel blank after the carrier plate has been divided aligning each panel blank and at least one processing tool of a processing device relative to one another according to the detected type or position of the at least one identification mark of each panel blank and machining locking profiles on at least two edges of each panel blank using the processing device whereby only at least a part of an edge of the groove remains as a recess in the edge region of the useable surface of the panel.

2. The method according to claim 1, further comprising, after the machining of the first locking profile on the at least one side of the at least one panel blank, detecting at least the type or position of the at least one identification mark of the at least one panel blank, aligning the at least one panel blank and at least one processing tool of a processing device relative to one another according to the detected type or position of the at least one identification mark, and machining a second locking profile in the at least one panel blank using the processing device on at least one side of the at least one panel blank not yet provided with the first locking profile.

3. The method according to claim 1, wherein the at least two grooves of the carrier plate are aligned perpendicularly to one another.

4. The method according to claim 1, at least one groove is formed on an edge region of each of two opposing panel blanks.

5. The method according to claim 1, wherein grooves are provided on four edge regions of the usable surface of the panel blanks.

6. The method according to claim 1, wherein locking profiles are machined in or on four edges of each panel blank.

7. The method according to claim 1, wherein the type or position of the at least one identification mark of the panel blanks is detected by an optical sensor.

8. The method according to claim 1, wherein the alignment of the panel blanks in relation to the at least one processing tool of the processing device is determined by an evaluation and control unit using the type or position of the at least one identification mark of the panel blanks.

9. The method according to claim 1, wherein aligning the panel blanks in relation to the at least one processing tool of the processing device comprises adjusting an adjustable stop that contacts the panel blanks.

10. The method according to claim 1, wherein aligning of the panel blanks in relation to the at least one processing tool of the processing device comprises adjusting the at least one processing tool.

11. The method according to claim 1, wherein the at least one groove in the edge region of the usable surface is configured as a chamfer or rounding and in which the grooves are provided so that two similar panels locked together form a mutual V-shaped, U-shaped or right-angled join.

12. The method according to claim 1, wherein, on the at least one web, the at least one identification mark symbol is provided and, further wherein at least a portion of the identification mark symbol is removed when the carrier plate is divided into the panel blanks.

13. The method according to claim 1, wherein the identification mark comprises at least one diamond symbol, a textured identification mark symbol, an identification mark symbol, or a combination of at least two of a diamond symbol, a textured identification mark symbol, and an identification mark symbol.

14. The method according to claim 1, further comprising impressing at least a part of the at least one identification mark and the at least two grooves in the carrier plate during pressing of the carrier plate with at least one protective layer.

15. The method according to claim 1, wherein, along the longitudinal sides of the panel blanks, the at least one identification mark includes at least two identification mark symbols or, along the transverse sides of the panel blanks, the at least one identification mark symbol is provided.

16. The method according to claim 1, wherein the carrier plate comprises a surface layer or wear layer.

17. The method according to claim 16, further comprising pressing the surface layer or wear layer with the carrier plate and pressing at least one of the at least two grooves during pressing of the surface layer or wear layer with the carrier plate.

18. The method according to claim 1, wherein the carrier plate comprises at least two grooves running substantially parallel and separated from one another by the at least one web, wherein, on the at least one web, the at least one identification mark or at least one identification mark symbol is provided or at least partially impressed, and the method further comprising imprinting the at least two substantially parallel grooves in the carrier plate using a pressing tool having at least two raised rib structures running substantially parallel to one another.

* * * * *